US005219150A

United States Patent [19]

Denysenko et al.

[11] Patent Number: 5,219,150

[45] Date of Patent: Jun. 15, 1993

[54] FLUID JACK FOR A HEAT EXCHANGER

[75] Inventors: Eugene S. Denysenko, Crystal; Guy T. Thompson, St. Paul, both of Minn.

[73] Assignee: Deltak Corporation, Minneapolis, Minn.

[21] Appl. No.: 774,009

[22] Filed: Oct. 8, 1991

[51] Int. Cl.[5] ..... B66F 3/24

[52] U.S. Cl. ..... 254/93 R; 414/191; 414/560; 29/890.031; 29/726.5

[58] Field of Search ..... 254/93 R, 93 H, 89 H, 254/93 A; 29/890.031, 726, 726.5, 244, 252; 414/162, 191, 199, 560

[56] References Cited

U.S. PATENT DOCUMENTS 3,519,246 7/1970 Belding ..... 259/93 R
3,785,026 1/1974 Ohmstede ..... 29/427
3,979,816 9/1976 Green ..... 29/244
4,685,426 8/1987 Kidaloski et al. ..... 122/214

*Primary Examiner*—Bruce M. Kisliuk
*Assistant Examiner*—Eileen P. Morgan
*Attorney, Agent, or Firm*—Quarles & Brady

[57] ABSTRACT

A heat exchanger has a duct with a tube assembly supported by a hanger that extends through an opening in the roof of the duct. A jack is provided to raise and lower the tube assembly during maintenance. The jack includes a base with an aperture therethrough and a pair of rollers attached to the underside of the base so that the jack can be moved across the roof. A pair of fluid operated cylinders are mounted on the base and project upward on opposite sides of the aperture. A jacking frame is attached to the other ends of both the cylinders and a rod extension passes through the base aperture for connecting the jacking frame to the hanger.

8 Claims, 3 Drawing Sheets

FIG. 3
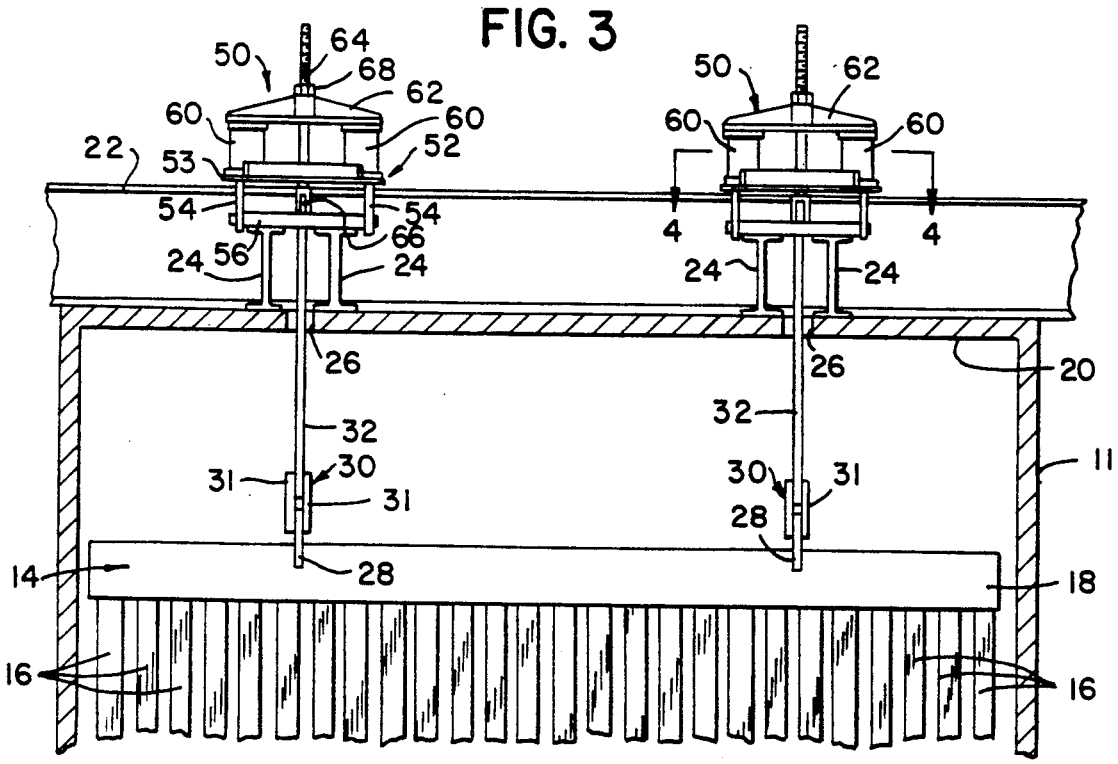
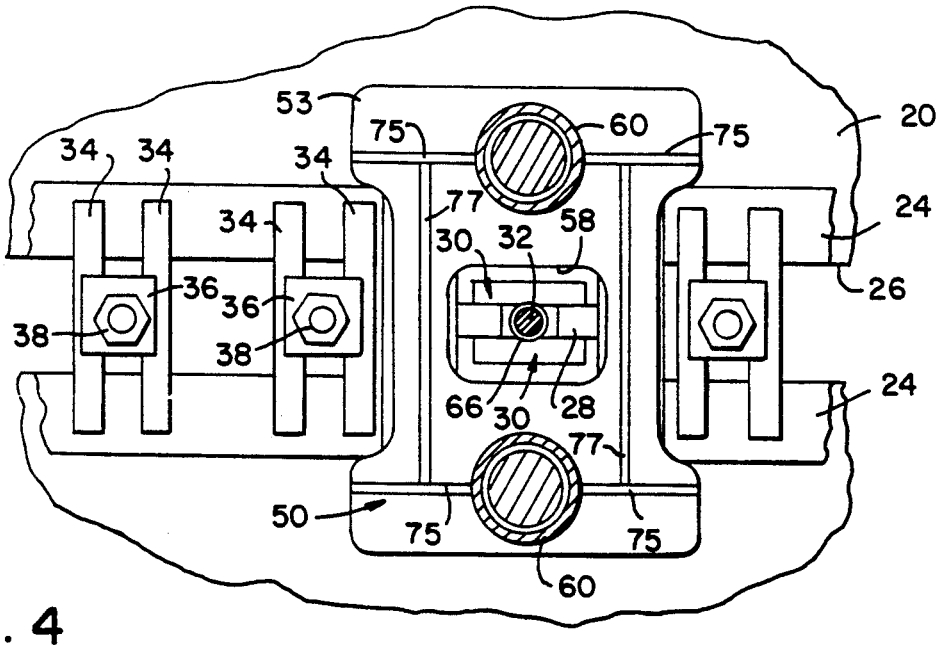
FIG. 4

FLUID JACK FOR A HEAT EXCHANGER

BACKGROUND OF THE INVENTION

The present invention relates to hydraulic and pneumatic jacks; and specifically to jacks for moving components of a heat exchanger, such as is found in boilers and heat recovery steam generators.

A considerable amount of heat energy remains in the exhaust gases from many combustion processes. Several decades ago, this "waste heat" was allowed to escape through the smoke stack. With a heightened desire to conserve energy and make combustion systems more efficient, the waste heat now is frequently passed through a heat recovery steam generator (HRSG) to transfer much of the remaining heat from the exhaust gases to water that flows through the steam generator. The resulting steam can be used to generate electricity or used in equipment converts the energy in the steam into mechanical energy.

Typical HRSG systems comprise heat exchanger formed by a large steel duct that channels hot gas over several banks of internal tubes which contain water. As the hot gases pass over the tubes, heat is absorbed by water flowing in the tubes. The tubes within a bank are divided into groups with the tubes in a given group connected to common upper and lower manifold headers to form a tube panel. For maximum heat transfer, conventional systems are designed so that the tube panels are packed very densely into the duct. The dense configuration forces the hot gas to flow directly over the tube surfaces. The ends of the tube panels are in close proximity to the walls of the duct to eliminate passages above, below and on either side of the panels through which the hot gases could bypass the tubes.

Although the dense tube configuration optimized the efficiency of previous HRSG systems, it made the systems very difficult to maintain. If the interior panels of a bank needed repair, large portions of the system had to be disassembled in order to gain access to those panels. This not only was very difficult but extremely time consuming, necessitating a long down time for the HRSG system. Even inspection of the inner tubes was difficult due to the dense configuration.

It is desirable to provide a heat exchanger which allows the panels of the normally densely packed bank to be moved for access by maintenance personnel. This requires a mechanism for moving the heavy panels of tubes.

SUMMARY OF THE INVENTION

A heat exchanger has a duct with a tube assembly supported by a hanger that extends through an opening in the duct. A jack is provided to raise and lower the tube assembly during maintenance procedures. The jack includes a base with an aperture therethrough and a pair of rollers attached to an underside of the base so that the jack can be moved across the roof.

A pair of fluid operated cylinders are mounted on the base and project upward on opposite sides of the aperture. A jacking frame is attached to the other ends of both the cylinders and an extension rod passes through the base aperture for connecting the jacking frame to the hanger. As fluid is pumped into each cylinder the jacking frame is raised with respect to the base of the jack. As the tube assembly of the heat exchanger is connected to the jacking frame, it too is raised by this action. By releasing the fluid from the cylinders the jacking frame is lowered with respect to the base of the jack.

BRIEF DESCRIPTION OF THE DRAWINGS

FIG. 3 is a cross sectional view taken at right angles to FIG. 2 across the width of the heat exchanger;

FIG. 4 is a view taken along line 4—4 in FIG. 3; and

DETAILED DESCRIPTION OF THE INVENTION

Although the present invention is being described in the context of a heat recovery steam generator, it has equal application to other types of heat exchangers, such as boilers, superheaters and economizers.

Figure 1:
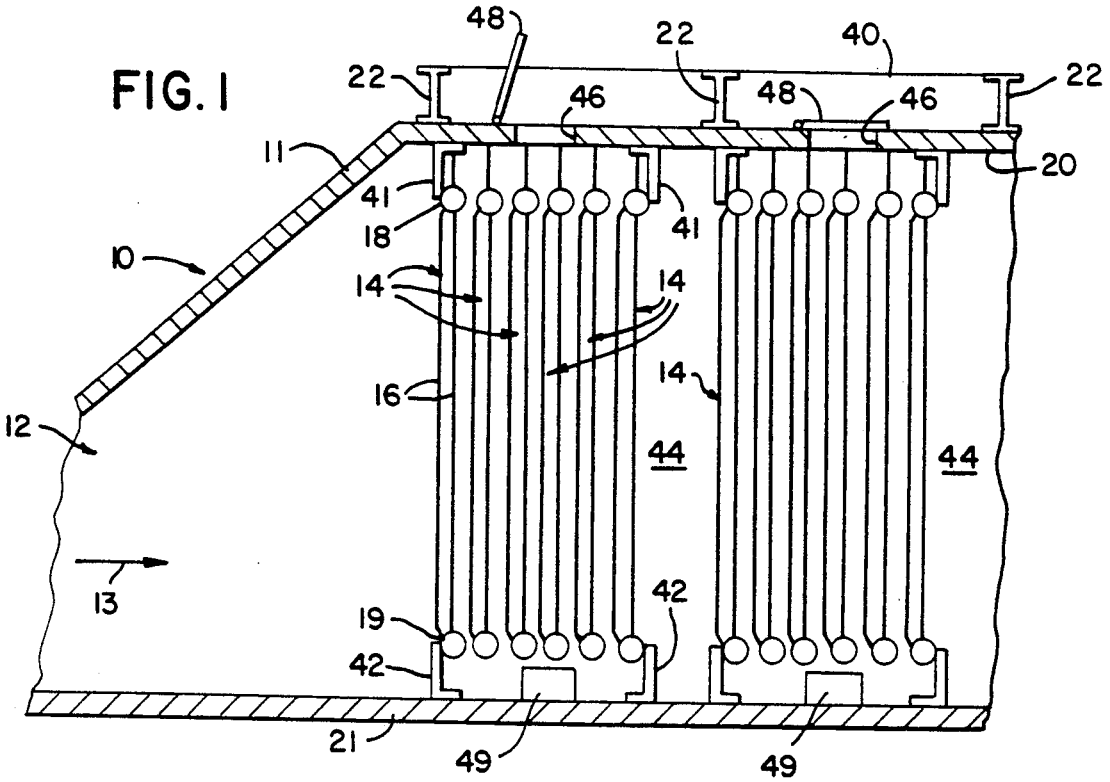
FIG. 1 is a cross sectional view through a heat exchanger according to the present invention.

With reference to FIG. 1, a heat recovery steam generator 10 includes a duct 11 with a gas inlet 12. Exhaust gases from a combustion process flow in the direction indicated by arrow 13 from the inlet 12 through the duct. The inlet opens into a large section of the steam generator which for example is fifty feet high, twelve feet across (in the dimension into the paper) and 120 feet long. The gas continues to flow through the duct to an outlet (not shown) on the remote end from the inlet 12.

Within duct 11 are a plurality of tube panels 14. Each panel consists of several tubes 16. The tubes 16 of each panel extend between an upper and a lower pipe header 18 and 19, respectively. Both headers 18 and 19 have a plurality of openings therein into which the tubes 16 are welded to provide fluid communication between the header and the tubes. Although not shown in the drawings, the headers of adjacent panels are connected together by additional piping so that water can be introduced into one of the headers, flow through the tubes 16 and out the other header. The welds of the tube to the headers are a common point of failure during operation of the steam generator 10.

Figure 2:
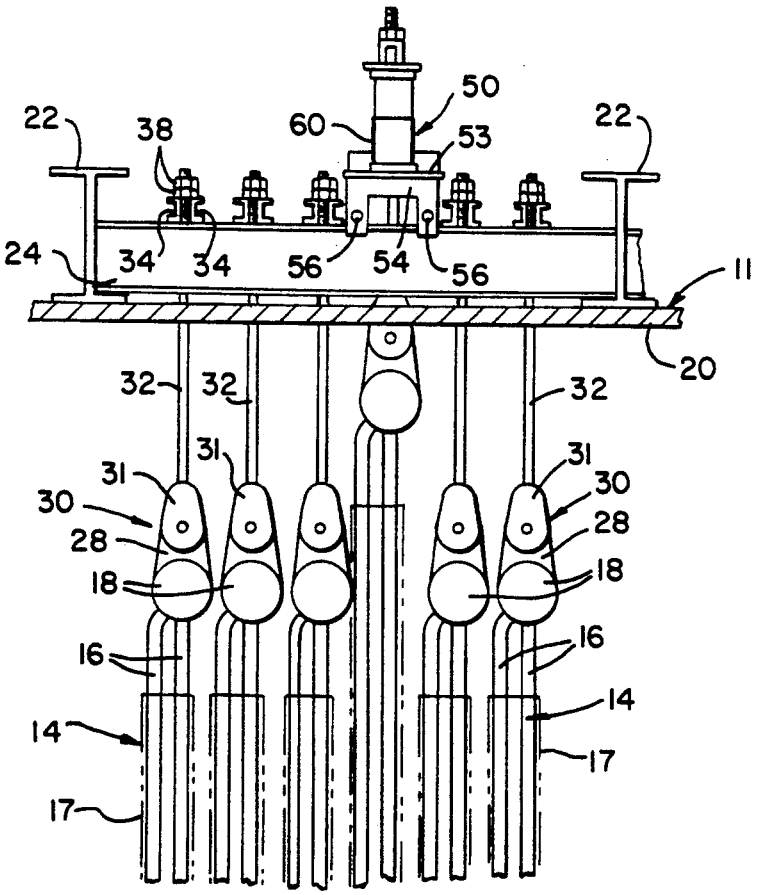
FIG. 2 is an enlarged view of a portion of FIG. 1 showing a tube panel in a raised state for inspection or repair.

As shown in FIGS. 1 through 3, a first set of vertical tubes 16 extend from the upper header 18 in a common plane across the duct. A second coplanar set of vertical tubes also extends from the upper header 14 offset from the first set along the direction of the gas flow. A separate helical fin assembly, indicated by broken lines 17, is attached to the exterior of each tube to increase heat transfer. As in previous steam generator designs, the tubes are closely spaced with respect to each other in both the longitudinal and transverse directions. This close spacing optimizes the heat transfer between the hot gas flowing through duct 11 and the water flowing through tubes 16.

Each panel 14 of tubes is suspended from the roof 20 of the duct 11 by a pair of hangers 30 thereby creating spaces in the duct above and below the panel. As shown in FIGS. 2 and 3, each hanger 30 includes a bracket 28 welded to the top surface of the upper pipe header 18. The bracket 28 has an aperture therethrough that receives a pin which attaches the bracket to a coupling member 31 at one end of a support rod 32. This assembly provides a pivotal connection of the tube panel 14 to the support rod 32. The support rods extend upward through elongated apertures 26 in roof 20.

A number of I-beams 22 extend transversely across the duct 11 on the exterior of roof 20 to support the tube assemblies. The ends of transverse beams 22 attach to vertical structural members (not shown) on the sides of the duct. Two pairs of longitudinal I-beams 24 are attached to and extend between adjacent transverse beams 22. As shown in FIG. 3, the longitudinal beams 24 of each pair are spaced apart and lie on either side of a elongated aperture 26 in the roof 20.

With reference to FIGS. 2 and 4, a C-support 34 bar is placed between the upper surfaces of the pair of longitudinal beams 24 on both sides of each support rod 32. The support rod passes upward through an aperture in a hanger plate 36 which spans adjacent C-support bars 34. The upper end of the support rod 32 is threaded and receives a pair of nuts 38 which are locked in place by tightening them against one another. A short portion of the support rod extends beyond the nuts 38.

During operation of the steam generator 10, a cover box 40 is placed over and welded to the longitudinal beams 24 to seal the aperture 26 in the duct roof 20 as shown in FIG. 1. The remaining figures of the drawings show the cover box 40 removed as occurs during inspection and maintenance of the steam generator.

The upper header pipes 18 are suspended approximately three feet below the roof 20. This space is sealed by baffle plates 41 bolted to the interior of the roof 20 before and after each group of panels 14. The baffle plates abut the upper pipe header 18 of the panels on each end of the group. These baffle plates 41 close the gap between the upper pipe headers 18 and the roof 20, thereby preventing the exhaust gases from passing above the group of tube panels. A similar pair of baffles 42 are welded to the floor 21 of the duct to likewise block exhaust gases from flowing in the space between the lower pipe headers 19 and the duct floor. Each group of tube panels 14 is separated by a cavity 44.

Access openings 46 are cut in the roof 20 and are sealed by doors 48 during generator operation. These openings allow service personnel to enter the duct for inspection and repair of the tube panels 14. Similar openings 49 are located on the sidewall of the duct 11 near the floor 21, allowing maintenance personnel access to the space below each group of panels.

The steam generator 10 is specifically designed for ease of maintenance. The spaces above and below each group of panels allow a technician to enter the duct and inspect the welds where tubes 16 attach to the upper and lower headers 18 and 19. The suspension of the tube panels 14 permits vertical movement for inspection and servicing as shown in FIG. 2.. To gain access to a specific panel, the connection of its upper and lower headers to interconnecting piping is severed. The panel then is raised or lowered by a pair of jacks 50 which are installed for that purpose.

Each jack 50 has a base 52 formed by a horizontal plate 53 and two spaced apart vertical plates 54 extending downward from the base plate 53. Each of the vertical members 54 has an inverted U-shape with the cross member of the U welded to base plate 53. Each leg of the U-shaped vertical member 54 has an aperture therethrough containing a ball bearing. A pair of rollers 56 extends between the vertical members 54 and fit into the ball bearings. When the jack 50 is placed on the steam generator 10, the rollers rest on the longitudinal beams 24 and permit movement of the jack along the beams.

With reference to FIG. 4 as well as FIG. 3, the base plate has a central opening 58 therethrough which is positioned over the end of a support rod 32. A pair of fluid operated cylinders 60, such as hydraulic or pneumatic cylinders, are mounted vertically on the upper surface of the base plate 53 of each jack 50. A jacking frame 62 extends between the upper ends of the cylinders 60. The jacking frame has a central aperture which is aligned with the end of the support rod 32 when the jack is positioned on the steam generator 10.

Prior to placing a jack 50 over the end of a support rod 32, a coupling 66 at one end of a rod extension 64 is threaded onto the upper end of the support rod 32. The other end of the extension rod 64 projects through the aperture in the jacking frame 62 and has a nut 68 threaded thereon.

To raise a panel 14, the jacks 50 are placed in their compressed state and attached to the support rods 32. Fluid is then pumped into each of the cylinders 60 thereby raising the jacking frame 62 and the panel 14 as shown in FIG. 2. Maintenance personnel then can enter the duct through one of the roof access openings 46 and visually inspect the welds along the raised upper pipe header 18.

In a similar manner, the tube panel 14 can be lowered for inspection of the lower pipe header 19. To accomplish this, a pair of jacks 50 are positioned over the pair of support rods for the panel and extended to substantially their full length by pumping hydraulic fluid into the cylinders 60. Nuts are tightened on the extension rods 64 which have been attached to the ends of the support rods 32. Additional fluid is pumped into the cylinder 60 to raise the panel 14 slightly. With reference to FIGS. 2 and 4, raising the panel 14 removes the pressure exerted by the hanger plates 38 on the C-supports 34. This permits the C-supports to be extracted between the legs of the U-shaped vertical members 54 of the jacks. The removal of the C-supports 34 allows the panel 14 to be lowered within the duct 11. To do so, fluid is released gradually from the cylinders 60 causing them to collapse under the weight of the panel 14 so that the lower pipe header 19 drops downward. A technician then can crawl along the floor 21 of the duct and inspect the welds on the lower pipe header 19. If necessary for access both above and below the panels 14, the baffles 41 and 42 can be removed temporarily.

Following inspection, the panel is raised so that a gap exists between the hanger plates 36 and the longitudinal beams 4 which is slightly greater than the height of the C-supports 4. The C-supports are inserted between the legs of the U-shaped vertical members 54 of the jack 50. Next the panel is lowered so that the hanger plates 34 drop onto the C-supports 34. At this time, the extension rods 64 can be removed and the jacks 50 transferred to raise or lower another panel 14 within the steam generator 10.

As noted previously, each of the support rods 34 extends through an elongated aperture 26 in the roof 20. This aperture runs substantially the full distance between the transverse beams 22. Should it become necessary, access between the tube panels 14 of a group can be accomplished by moving the panels along these apertures 26. To do so, the appropriate baffles 41 and 42 are removed and the jacks 50 are attached to the outermost panel 14 of the group. That panel then is raised upward an moved longitudinally by rolling the jack 50 over the longitudinal beam 24 until the panel has been pushed away from the others. The outermost panel then can be lowered onto properly positioned C-supports 34 and the jack 50 used to similarly move other panels of the group until a space exists adjacent the panel that requires inspection or repair. The maintenance personnel enter the space created between the panels to perform the necessary work.

At the completion of the maintenance, the panels are moved back into their original positions and reattached to the interconnecting piping which carries water to and from the panel assembly. The doors over openings 46 and 49 are closed and the cover box 40 welded in place to seal the apertures 26 in roof 20.

Figure 6:
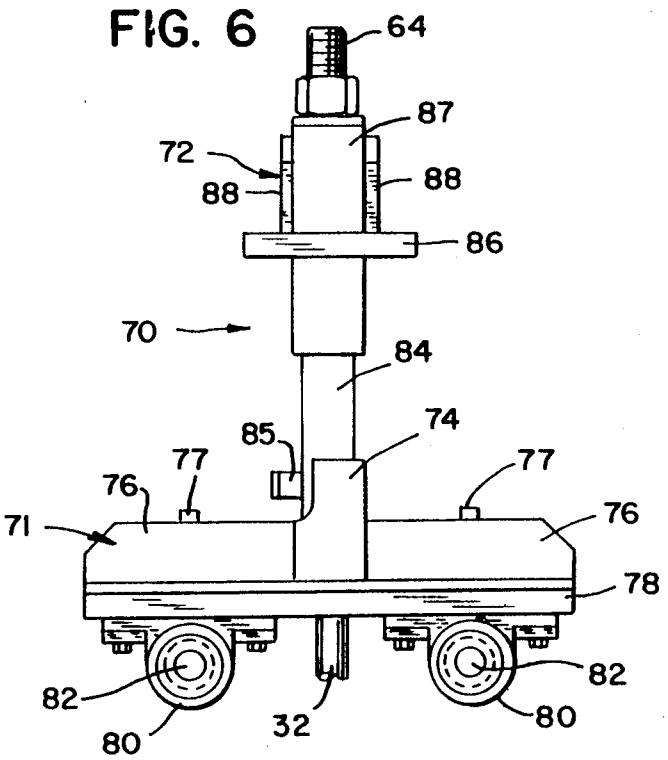
FIGS. 5 and 6 illustrate two orthogonal plane views of another embodiment of a jack for moving the tube panels.
Figure 5:
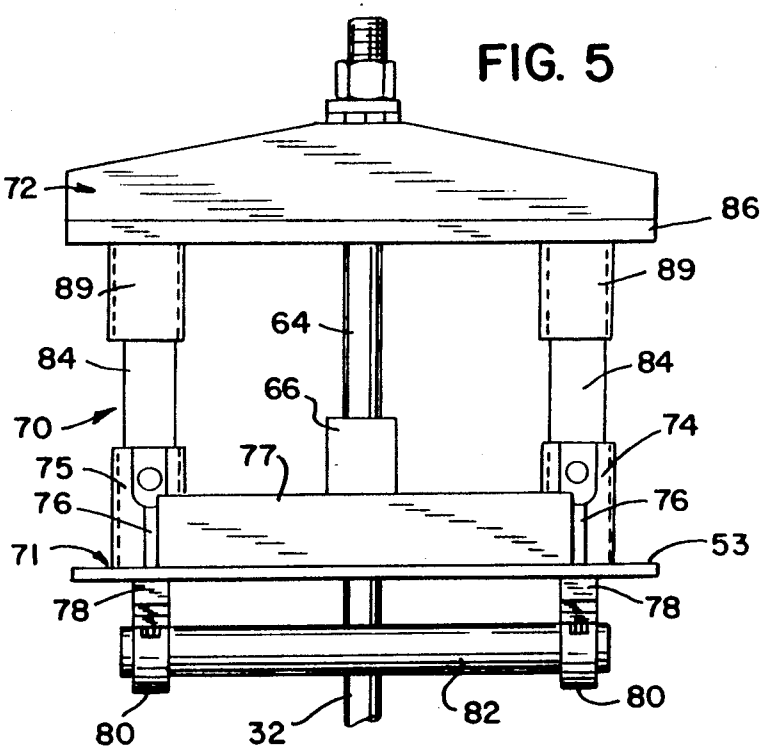

FIGS. 5 and 6 show orthogonal views of another embodiment of a jack 70 that can be used to move the tube panels 14 within the steam generator 10. Jack 70 is formed by a base assembly 71 and an upper jacking frame 72. The base assembly 71 includes a flat base plate 53 identical to the one shown in FIG. 4 which bears the same reference numeral. Two hollow tubular members 74 and 75 are mounted on the upper surface of the base plate 53 on opposite sides of the central opening 58. A separate pair of side braces 76 is attached to each of the tubular members 74 and to provide lateral support. A pair of cross bars 77 extend between the side braces 76 on opposite sides of the central opening 58. The side braces 76 and cross bars 77 are welded to each other, to the base plate 53 and to tubular members 74 and 75.

Two mounting bars 78 are welded on the under side of the base plate 53 beneath the side braces 76. A ball bearing assembly 80 is bolted at each end of the mounting bars 78. Two rollers 82 extend between opposing pairs of ball bearing assemblies 80. These roller bars 82 rest on the longitudinal I-beams 24 when the jack 70 is placed on the steam generator 10. The length of the roller bars and the spacing between the ball bearing assemblies 80 is selected so that the jack 70 can span the upper plates of a pair of longitudinal I-beams 24 as shown in FIG. 3 with respect to jack 50. In this position, the ball bearing assemblies guide the jack 70 as it rolls along the I-beams preventing the jack from riding off the beam.

A fluid operated cylinder 84 is mounted vertically within each of the tubular members 74 and 75 of the base assembly 71. Each cylinder 84 has a fitting 85 through which hydraulic fluid can be pumped and withdrawn to extend and contract the cylinder.

The jacking frame 72 has a cross plate 86 with a cylindrical member 87 mounted on its upper surface over a centrally located aperture through the cross plate. The rod extension 64 extends through the aperture in cross plate 86 and another aperture in cylindrical member 87 when the jack 70 is placed on the steam generator 10. The cylindrical member 87 is supported by two side plates 88 welded to opposite sides of the member and to the cross plate 86. Two cylinder tubes 89 are welded to the underside of the cross plate 86 and spaced apart to receive the upper ends of the cylinders 84.

When fluid is pumped to extend each of the cylinders 84, the jacking frame 72 is raised with respect to the base assembly 71. This action pulls the extension rod 64 and the support rod 32 upward with respect to the duct 11 on which the jack 70 is mounted. By pushing laterally, the jack 70 can be rolled along the longitudinal I-beams 24. The cylinders 84 collapse when the fluid is released, thereby lowering the jacking frame toward the base assembly 71. The contraction of the cylinders 84 is aided by the weight of the tube panel 14 that is exerted downward on the jacking frame 72.

We claim:

1. A jack, for use with a heat exchanger which includes a tube assembly supported by a hanger than extends through an opening in the heat exchanger, said jack comprising:

a base having a first aperture therethrough;

a pair of rollers rotably attached to and underneath said base;

a pair of fluid operated cylinders coupled at one end portion to said base and projecting upward from said base on opposite sides of the first aperture;

a jacking frame attached to another end portion of both fluid operated cylinders, and having a second aperture therethrough; and a means for attaching said jacking frame to the hanger and including an extension which can be attached to a section of the hanger that extends through the opening in the heat exchanger, the extension extending through the second aperture and having an adjustable mechanism which limits downward movement of the extension through the second aperture.

2. The jack as recited in claim 1 further comprising two pairs of ball bearing assemblies attached to an underside of said base, with each pair engaging one of said rollers.

3. The jack as recited in claim 1 wherein said base includes:

a base plate having a first surface to which said pair of rollers are attached and having a second surface; and a pair of tubular members attached to and extending upward from the second surface of said base plate, and receiving the one end portions of said cylinders.

4. A jack, for use with a heat exchanger which includes a tube assembly supported by a hanger that extends through an opening in the heat exchanger, said jack comprising:

a base plate having first and second opposed surfaces and having a first aperture extending therethrough;

a pair of rollers rotatably attached to the first surface of said base plate;

first and second tubular members attached to and extending from the second surface of said base plate on opposite sides of the first aperture;

a jacking frame plate having two opposed surfaces and a second aperture therethrough;

a jacking frame plate having two opposed surfaces and a second aperture therethrough;

third and fourth tubular members attached to and extending from one of the surfaces of said jacking frame plate;

a first fluid operated cylinder having one end received in said first tubular member and another end received in said third tubular member;

a second fluid operated cylinder having one end received in said second tubular member and another end received in said fourth tubular member;

a means, extending from said jacking frame plate and aligned with the first aperture in said base plate, for attachment to the hanger; and a member having a third aperture and mounted on the other surface of said jacking frame plate in a position in which the second and third apertures are aligned and received said means for attachment.

5. The jack as recited in claim 4 wherein each rollers are attached to said base plate by a pair of ball bearing assemblies.

6. The jack as recited in claim 5 wherein said pair of ball bearing assemblies is spaced along a length of said roller by a distance that enables the roller to ride on a beam of the heat exchanger with the bearing assemblies engaging edges of the beam to prevent the jack from riding off the beam.

7. A jack, for use with a heat exchanger which includes a tube assembly supported by a hanger that extends through an opening in the heat exchanger, said jack comprising:

a base plate having an aperture extending therethrough from one surface;

a pair of rollers rotatably attached underneath said base plate;

first and second tubular members attached to the one surface of said base plate on opposite sides of the aperture;

first and second side braces connected to said first tubular member and to said base plate;

a jacking frame plate having two opposed surfaces;

third and fourth tubular members attached to and extending from one of the surfaces of said jacking frame plate;

third and fourth side braces connected to said second tubular member and to said base plate;

a first fluid operated cylinder having one end received in said first tubular member and another end received in said third tubular member;

a second fluid operated cylinder having one end received in said second tubular member and another end received in said fourth tubular member; and a means, extending from said jacking frame plate and aligned with the aperture in said base plate, for attachment to the hanger.

8. The jack as recited in claim 7 further comprising a first cross bar connected between the first and third side braces; and a second cross bar connected between the second and fourth side braces.

* * * * *